US010254070B2

(12) United States Patent
Briody et al.

(10) Patent No.: US 10,254,070 B2
(45) Date of Patent: Apr. 9, 2019

(54) INTEGRATED FIREARM LOCK AND BORE CLEANER

(71) Applicant: BV Technology, LLC, Alto, MI (US)

(72) Inventors: Robert Thomas Briody, Alto, MI (US); Yen-oanh Vo, Alto, MI (US)

(73) Assignee: BV TECHNOLOGY, LLC, Alto, MI (US)

( * ) Notice: Subject to any disclaimer, the term of this patent is extended or adjusted under 35 U.S.C. 154(b) by 122 days.

(21) Appl. No.: 15/359,859

(22) Filed: Nov. 23, 2016

(65) Prior Publication Data

US 2017/0146313 A1 May 25, 2017

Related U.S. Application Data

(60) Provisional application No. 62/259,455, filed on Nov. 24, 2015.

(51) Int. Cl.

| | |
|---|---|
| ***F41A 29/02*** | (2006.01) |
| ***E05B 73/00*** | (2006.01) |
| ***E05B 67/38*** | (2006.01) |
| ***F41A 17/44*** | (2006.01) |
| *B08B 9/00* | (2006.01) |
| *B08B 9/043* | (2006.01) |

(52) U.S. Cl.

CPC ..... *F41A 29/02* (2013.01); *E05B 67/383* (2013.01); *E05B 73/0005* (2013.01); *F41A 17/44* (2013.01); *B08B 9/00* (2013.01); *B08B 9/0436* (2013.01)

(58) Field of Classification Search

CPC . F41A 29/02; F41A 17/44; B08B 9/04; E05B 67/383; E05B 73/0005

See application file for complete search history.

(56) References Cited

U.S. PATENT DOCUMENTS

| | | | | |
|---|---|---|---|---|
| 1,164,665 A | | 12/1915 | Reeves | |
| 2,763,081 A | | 9/1956 | Huckabee | |
| 3,137,957 A | | 6/1964 | Ingalls | |
| 3,205,518 A | * | 9/1965 | Romaine | B08B 9/0436 15/104.165 |
| 3,368,297 A | | 2/1968 | Lentz | |
| 3,708,820 A | | 1/1973 | Schultea | |
| 3,813,802 A | | 6/1974 | Di Prospero | |
| 4,010,565 A | | 3/1977 | DiProspero | |
| 4,873,778 A | * | 10/1989 | Stipp | F41A 29/02 15/104.165 |

(Continued)

FOREIGN PATENT DOCUMENTS

EP 0981409 B1 2/2003

*Primary Examiner* — Sharidan Carrillo

(74) *Attorney, Agent, or Firm* — Price Heneveld LLP

(57) ABSTRACT

A method for cleaning and blocking the bore of the firearm includes inserting the cleaning and blocking device into the bore where the cleaning and blocking device includes a cleaning body having a foam core enclosed in a tubular sheath. A first pull-cord is coupled to a first end of the cleaning body and a second pull-cord is coupled to a second end of the cleaning body. A locking mechanism is additionally coupled to the first and second pull-cords. The method further includes pulling the cleaning body back and forth at least once through the bore with at least one of the pull-cords. The method also includes locking the cleaning and blocking device by coupling a lock to the locking mechanism of the first and second pull-cords.

6 Claims, 9 Drawing Sheets

(56) References Cited

U.S. PATENT DOCUMENTS

| | | | | |
|---|---|---|---|---|
| 5,016,377 | A | 5/1991 | Gunning | |
| 5,871,589 | A * | 2/1999 | Hedge | F41A 29/02 134/8 |
| 5,934,000 | A | 8/1999 | Hayes, Sr. | |
| 7,367,151 | B1 * | 5/2008 | Black | F41A 29/00 15/104.05 |
| 8,695,264 | B1 * | 4/2014 | Blackburn | F41A 29/02 42/95 |
| 2004/0111948 | A1 * | 6/2004 | Schnell | F41A 29/02 42/95 |
| 2006/0288625 | A1 * | 12/2006 | Williams | F41A 17/44 42/70.11 |
| 2011/0099880 | A1 * | 5/2011 | Stephens | F41A 29/02 42/95 |
| 2012/0132549 | A1 * | 5/2012 | Dewey | B08B 9/00 206/223 |
| 2012/0261368 | A1 * | 10/2012 | Klein | A47B 81/005 211/64 |
| 2014/0082989 | A1 * | 3/2014 | Canham | F41A 29/02 42/95 |
| 2014/0123529 | A1 * | 5/2014 | Williams | F41A 29/02 42/95 |
| 2016/0223283 | A1 * | 8/2016 | Brooker | F41A 29/02 |
| 2016/0223284 | A1 * | 8/2016 | Brooker | F41A 29/02 |
| 2017/0146313 | A1 * | 5/2017 | Briody | F41A 29/02 |

* cited by examiner

INTEGRATED FIREARM LOCK AND BORE CLEANER

CROSS-REFERENCE TO RELATED APPLICATION

This application claims priority under 35 U.S.C. § 119(e) to U.S. Provisional Patent Application No. 62/259,455, filed Nov. 24, 2015, entitled "INTEGRATED FIREARM LOCK AND BORE CLEANER," which is herein incorporated by reference in its entirety.

FIELD OF THE DISCLOSURE

The present disclosure generally relates to a device and method for the safety and maintenance of a firearm, and in particular, to a device that efficiently cleans the barrel bore of a firearm while additionally providing a means for the device to be blocked in order to prevent a round from being chambered into the barrel.

BACKGROUND OF THE DISCLOSURE

The United States Bureau of Alcohol, Tobacco, Firearms and Explosives estimates that there are about 300 million guns in the United States. Every year, thousands of unintentional deaths and injuries occur because of improper handling including the handling of firearms that are improperly secured. Between 1999 and 2010 , over 8,300 people in the United States were reported as dying from unintentional shootings, including 2,383 children and young people between the ages of 0 and 21 years old.

There is a constant demand by consumers for an improved locking device that is both affordable and convenient. Many of the options currently available to lock or disable a firearm from being fired focus on disabling various parts of the firearm. For example, a popular item currently sold in gun shops is a trigger blocking device that is installed by screwing together two pieces using a special screwdriver having two small points. This device offers protection for the person who is concerned about young children handling or playing with the firearm unsupervised, but a teenager with mechanical skills can easily shape a piece of metal with which to remove the screw, or even remove the screw with a pointed instrument, and thereby defeat the device. Furthermore, a trigger blocking device does not prevent either the loading or the cocking of the firearm, which might then be discharged in consequence of receiving a sharp blow as in being dropped. Locking devices that offer consumers additional uses or benefits in combination with locking the firearm would be considered as beneficial.

When a bullet is fired in a gun, explosive chemicals inside the cartridge are ignited. Inside the barrel of most modern guns there are precision spiral cut grooves, called riflings, which cause the bullet to rotate as it passes down the barrel and over the rifling. The rotation of the bullet as it leaves the barrel greatly enhances the accuracy of its flight. As the bullet passes through the gun barrel, it touches the side of the gun barrel and leaves traces of metal. In addition to metal deposited by the bullet, the expanding gasses of combustion leave particle and film residues on the inside of the barrel. Both of these deposits can build up with repeated firings. In an extreme condition, deposits of bullet material as well as residues of combustion can build up on the walls of the gun barrel to a point that accuracy is affected and back pressures may become dangerously high.

To prevent this buildup of material inside the gun barrel, deposits within the gun barrel must be removed by cleaning. Traditionally, cleaning of gun barrels is accomplished either by forcing a wire brush through the gun barrel, or by forcing an oiled or solvent saturated cloth through the gun barrel. Often these operations are performed sequentially. One widely used method for cleaning gun barrels in this manner is by the use of a rigid aluminum rod which is in short sections approximately 8" long. The ends of each section are threaded and screwed together. On the end of an assembled rod, utensils are screwed into the rod. These utensils can include a wire brush or a slotted metal tool into which a cloth patch or swab is inserted. Solvent can be applied to the cloth patch or brush to help loosen hardened residues in the barrel. The metal brush is pushed completely through the barrel and pulled out again. The metal brush is most effective in loosening metal particles and other hardened residues inside the gun barrel. After the barrel has been subjected to cleaning with a metal brush, multiple clean swabs are usually run through the barrel to absorb the solvent and loosened residue. The final step in the process is usually another clean swab to which a small amount of light gun oil is applied. This leaves a layer of oil on the metal of the barrel to protect from rust and corrosion.

The use of a sectional rod with utensils at its end has several disadvantages. First, the rod normally requires assembly, disassembly, and multiple changes of attachments using various cleaning patches during the process. Another disadvantage with using rigid rods with wire brush utensils at their end is the inability of such combinations to make mid-bore directional changes. In the case of a brush performing a mid-bore directional change, the wires of the brush are forced to change from a sloped back angle to a sloped forward angle. This change in alignment of the brush filaments can increase the resistance of the brush traveling through the barrel by 400%, possibly causing damage to the interior barrel finish or metal passivation(s).

Another problem with many current cleaning devices is that they contain exposed metal parts. A wire brush typically in use in the industry consists of steel spiral wire in which relatively soft, phosphor-bronze metal bristles of the brush are bound. The spiral wire of these wire brushes is exposed at the end. Many devices also contain fittings, connections, clamps, crimps, wires, push rod tips and other metal parts. Any of these metal parts can, either by poor design, misuse, carelessness, or accident, be damaging or abrasive to sensitive rifle barrel areas, especially the throat, rifling, and crown. Damage to these areas is an especially important consideration to knowledgeable gun owners including: marksmen, long-range shooters, and owners of fine, high-grade rifles and pistols. Damage to these areas often occurs when cleaning utensils are inserted into the barrel. At the moment of insertion, the rod or utensil may be at an angle to the long axis of the barrel, and this can allow the tip of the wire brush to touch the sides of the barrel or the rifling of the barrel. Any hardened metal-to-metal contact with the rifling or the barrel can cause damage.

In some instances a gun barrel will have dirt, mud, sand, ice, or other such environmental debris in the gun barrel. If this material is abrasive, such as sand or dirt, it is advisable this abrasive material be removed before a metal brush is passed through the barrel. If a metal brush is passed through a sandy or dirty barrel, the sand and/or dirt may become embedded in the bristles of the brush and can be ground into the gun barrel as an abrasive. This can scratch and cause uneven wear to the gun barrel and the rifling. In these situations, one should use a utensil to clean out such environmental debris before the metal brush goes through the barrel. Current barrel cleaning devices do not provide a means of doing this except to add another step to the process and run a clean patch in and then out of the barrel. To do a good job of cleaning environmental debris from a barrel, three or more clean patches might be required. Since sand and dirt are most likely to be in a barrel during field conditions, such an inconvenient cleaning process is not likely to be utilized, even if the user has gone to the trouble of carrying a cleaning kit with him or her.

Brush-based bore cleaners currently on the market can only travel/clean in one direction. Thus, they're incapable of 'scrubbing' a barrel. Some products have no brush. Thus, these products can be pulled in either direction through a barrel with equal effectiveness. When comparing a brushless device to cleaning with cotton fabric patches, a brushless device has a much larger surface area for cleaning and will yield a better and faster clean. The cleaning performance of a brushless device is greatly enhanced when used with a firearm liquid cleaning product or solvent mixture (such as Hoppes 9, Kroil, Gunzilla, etc.). Cleaning is maximized when used with a multifunction solvent and lubricant that softens, loosens, and dissolves burnt nitro-powder residues.

BRIEF SUMMARY OF THE DISCLOSURE

According to one aspect of the present disclosure, a method for cleaning and blocking a bore of a firearm is provided. The method includes inserting a cleaning and blocking device into the bore, the device comprising a cleaning body having a foam core enclosed in a tubular sheath, a first pull-cord coupled to a first end of the cleaning body and a second pull-cord coupled to a second end of the cleaning body, and a locking mechanism to couple the first and second pull-cords, pulling the cleaning body back and forth at least once through the bore with at least one of the pull-cords, and locking the cleaning and blocking device by coupling a lock to the locking mechanism of the first and second pull-cords.

According to another aspect of the present disclosure, a cleaning and blocking device for a firearm is provided. The cleaning and blocking device includes a cleaning body having a foam core enclosed in a tubular sheath, a first pull-cord coupled to a first end of the cleaning body and a second pull-cord coupled to a second end of the cleaning body, and a locking mechanism coupled to the first and second pull-cords.

According to another aspect of the present disclosure, a method for cleaning and blocking a tube having at least two open ends is provided. The method includes inserting a cleaning and blocking device into the tube, the device comprising a cleaning body having a foam core enclosed in a tubular sheath, a first pull-cord coupled to a first end of the cleaning body and a second pull-cord coupled to a second end of the cleaning body, and a locking mechanism coupled to the first and second pull-cords, and locking the cleaning and blocking device by coupling the locking mechanism of the first and second pull-cord heads.

These and other features, advantages, and objects of the present disclosure will be further understood and appreciated by those skilled in the art by reference to the following specification, claims, and appended drawings.

DETAILED DESCRIPTION

Figure 1:
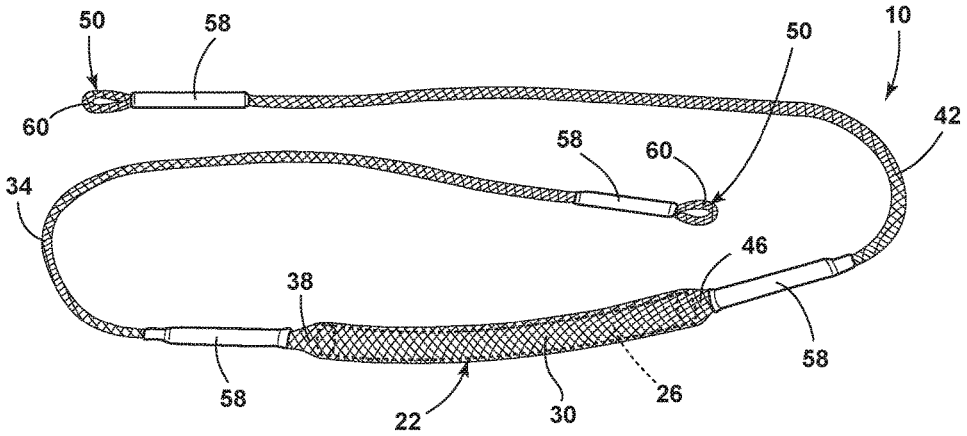
FIG. 1 is a perspective view of a cleaning and blocking device according to one aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-11B, the reference numeral 10 generally designates a cleaning and blocking device for a bore 14 of a firearm 18. The method for cleaning and blocking the bore 14 of the firearm 18 includes inserting the cleaning and blocking device 10 into the bore 14 where the cleaning and blocking device 10 includes a cleaning body 22 having a foam core 26 enclosed in a tubular sheath 30. A first pull-cord 34 is coupled to a first end 38 of the cleaning body 22 and a second pull-cord 42 is coupled to a second end 46 of the cleaning body 22. A locking mechanism 50 is additionally coupled to the first and second pull-cords 34, 42. The method further includes pulling the cleaning body 22 back and forth, partially or completely, at least once through the bore 14 with at least one of the pull-cords 34, 42. The method also includes locking the cleaning and blocking device 10 by coupling a lock 54 to the locking mechanism 50 of the first and second pull-cords 34, 42.

It is understood that any of the descriptions outlining and teaching a gun bore cleaning and blocking device discussed below, which can be used in any combination, can apply to this first embodiment of the disclosure where applicable, disclosing a gun bore cleaning and blocking device.

As shown in FIG. 1, the cleaning and blocking device 10 has the foam core 26 enclosed in the tubular sheath 30 to make up the cleaning body 22. The cleaning body 22 has the first end 38 and the second end 46 enclosed in a shrink tube cover 58 where the first and second ends 38, 46 are coupled to the first and second pull-cords 34, 42. The locking mechanism 50 shown in the embodiment of FIG. 1 is an end loop 60 formed at each terminal end of the first and second pull-cords 34, 42. The end loops 60 are formed by looping over the ends of the respective pull-cords 34, 42 and connecting the end to its respective cord to form the end loop 60 at each terminal end of the first and second pull-cords 34, 42. The shrink tube cover 58 may be coupled over the region where the loop is folded over onto the pull-cords.

In some embodiments, the tubular sheath 30 may be constructed from a braided poly-paraphenylene terephthalamide (KEVLAR®), poly-metaphenylene isophthalamide (NOMEX®), or other aramid fiber material. In some embodiments, the tubular sheath 30 is a braided tubular poly-paraphenylene terephthalamide sheath having a weight of about 10.6 ounces per square yard. In other embodiments, the aramid fiber material can have a varied weight from about 5 to about 15 ounces per square yard, about 7 to about 13 ounces per square yard, or about 9 to about 12 ounces per square yard. In many instances, a larger diameter barrel bore requires a heavier weighted aramid fiber material for durability and cleaning ability. In some embodiments, the tubular sheath is made from a braided poly-paraphenylene terephthalamide fiber having a weight from about 10 to about 12 ounces per square yard to yield the desired strength, durability, cleaning effectiveness, and cost.

The tubular sheath 30 may have the braided aramid fiber uniformly woven in all 3-axis directions (triaxial weave) to provide optimal cleaning, regardless of the direction it is pulled through the bore 14 of the firearm 18. The color of the tubular sheath 30 is not meant to be limiting although, in some examples, the tubular sheath 30 is a braided tubular poly-paraphenylene terephthalamide having a shade of yellow color. The yellow color offers the advantage of showing the user how dirty the cleaning and blocking device 10 is. The aramid fiber materials, for example the poly-paraphenylene terephthalamide, offer cut-resistance, strength, and chemical stability so the tubular sheath 30 can be used with a wide variety of cleaning solvents, washing materials, or with surfaces on the bore 14 of the firearm 18 barrel 78 that are sharp and would easily cut non-aramid fabrics. Synthetic fiber materials such as rayon, nylon, polyester, etc. are unacceptable as they lack strength, chemical resistance, abrasion resistance, and cut resistance.

The cleaning body 22 has first and second ends 38, 46 that are coupled, respectively, to the first and second pull-cords 34, 42. In many embodiments, the first and second ends 38, 46 of the cleaning body 22 are arbitrarily assigned and are not designed to be different. In other embodiments, the first end 38 may have a longer length than the second end 46.

The foam core 26 may be selected from a closed-cell non-absorbent foam having a density from about 1.0 to about 10.0 pounds per cubic foot, about 1.0 to about 5.0 pounds per cubic foot, or about 2.0 to about 3.0 pounds per cubic foot. In some examples, the closed-cell non-absorbent foam core has a density of about 2.2 pounds per cubic foot, about 3.0 pounds per cubic foot, or about 3.5 pounds per cubic foot. The foam density may be altered depending on numerous parameters such as the inside diameter of the bore, desired bore wall pressure, length of cleaning body 22, and the composition of burnt propellant being cleaned from the bore walls.

In some examples, the foam core 26 can be a polyethylene foam with a melting point of about 120° C. Other non-limiting examples of materials that can be used for the closed-cell non-absorbent foam core are low density polyethylene, high density polyethylene, polypropylene, polyurethane, or ethylene propylene copolymers. In some embodiments, the foam core 26 can be spooled from a reel and may be cut to length and optionally beveled on one end (depending on how close the foam core 26 diameter is to the maximum diameter of the tubular sheath 30 or tubular braided poly-paraphenylene terephthalamide sheath). The foam core 26 and the corresponding cleaning body 22 are able to be air dried without the need to place the cleaning and blocking device 10 in a drying device.

An open-cell non-absorbent foam material is not a desired material to be used for the foam core 26. Open-cell non-absorbent foam materials can retain or pass residual cleaning materials, dirt, water, hold/retain liquids, and have poor chemical resistance. As a result, these open-cell foams do not make good materials for the foam core 26 used in the cleaning body 22 of the cleaning and blocking device 10. Closed-cell foams are not breathable, will not absorb or retain liquids, and have excellent chemical resistance, as in the case of the polyethylene foam, used in some embodiments for the foam core 26.

The first and second pull-cords 34, 42 may be constructed from a poly-paraphenylene terephthalamide (KEVLAR®), poly-metaphenylene isophthalamide (NOMEX®), or other aramid fiber material. In some embodiments, the first and second pull-cords 34, 42 are made from a woven poly-paraphenylene terephthalamide material. In some embodiments, the first and second pull-cords 34, 42 can be constructed with the same type of material used to construct the tubular sheath 30. The first and second pull-cords 34, 42 may similarly have a tubular geometry but have a smaller cross-sectional diameter than the tubular sheath 30. The first and second pull-cords 34, 42 are coupled to the first and second ends 38, 46 of the cleaning body 22 where the smaller diameter of the first and second pull-cords 34, 42 can help prevent the foam core 26 from sliding out of the tubular sheath 30. The color of the pull-cords 34, 42 is not meant to be limiting although, in some examples, the pull-cords 34, 42 are a braided tubular poly-paraphenylene terephthalamide having a shade of yellow color.

Figure 2:
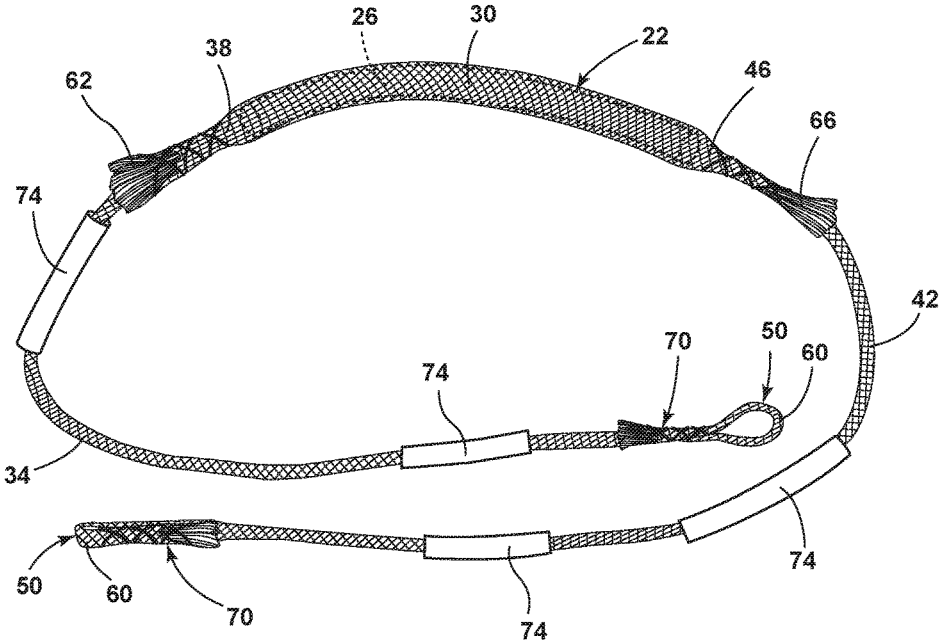
FIG. 2 is a perspective view of a partially assembled cleaning and blocking device according to one aspect of the present disclosure.

The shrink tube covers 58 are polymeric materials that tie or enclose the coupled portions of the cleaning and blocking device 10 such as a first and second connecting portion 62, 66 (shown in FIG. 2). In some embodiments, the shrink tube covers 58 are an adhesive-lined thermal shrink tube that can provide a transition from the first and second pull-cords 34, 42 to the cleaning body 22 of the cleaning and blocking device 10. In addition, these shrink tube covers 58 can protect a stitching 70 (shown in FIG. 2) used to couple first and second ends 38, 46 of the cleaning body to the first and second pull-cords 34, 42. The shrink tube covers 58 can also cover the stitching 70 of the end loops 60 on the terminal ends of the first and second pull-cords 34, 42. In some embodiments, the shrink tube covers 58 may have a variety of different adhesive linings on an inside portion of the shrink tube cover 58 that couples the respective connecting portions 62, 66. The shrink tube covers 58 have a length long enough to cover the stitching 70 and a thickness to significantly contribute to the total diameter of the joint. To successfully conceal the stitching 70, the shrink tube covers 58 must have a minimum of a 2:1 normal ID to shrink ID ratio or in other embodiments a 3:1 or 4:1 normal ID to shrink ID ratio. In other embodiments, the shrink tube covers 58 can provide additional chemical stability through the adhesive lining coupled to its inside portion. In some embodiments, the shrink tube covers 58 may be substituted with a molded rubber or a plastic piece that can cover the first and second connecting portions 62, 66 and any areas having stitching 70. In other embodiments, the first and second connecting portions 62, 66 and any areas having stitching 70 may be dipped and/or coated in an epoxy or other resin material that can be cured to provide a resin cover providing a more chemically stable environment for the covered portion.

The locking mechanism 50 may be any means in the art for coupling and locking the terminal ends of the first and second pull-cords 34, 42 on the cleaning and blocking device 10. In some embodiments, the locking mechanism 50 may be end loops 60, stiffened end members 120, clasps, hooks, fasteners, and/or built-in cable-like locks. In some embodiments, the locking mechanism 50 may require an additional lock 54 or other fastening device to actuate or couple the locking mechanism 50. Depending on the type or design of locking mechanism 50, the need for an additional or separate lock 54 or device may be needed. Crimped metal or composite ends could also be used in combination with a locking cap 94 (shown in FIG. 6) and a pass-through shackle or lock 54 into the locking mechanism 50.

The end loops 60 may be sized to accommodate lock shackles 86 of various sizes. In some embodiments, the shackle 86 may have a diameter of about ⅛", 3/16", ¼", 5/16", ⅜", ½", 9/16", ⅝", 11/16", ¾", 13/16", ⅞", and 1". In some embodiments, the end loops 60 are machine stitched with poly-paraphenylene terephthalamide thread or stitching 70 using a linear locking stitch, common for commercial sewing machines.

Referring now to FIG. 2, a partially assembled cleaning and blocking device 10 is shown. The first and second pull-cords 34, 42 are shown coupled to the first and second ends 38, 46 of the cleaning body 22 through the first connecting portion 62 and the second connecting portion 66. The stitching 70 is sewn through the first and second connecting portions 62, 66 to couple the first and second pull-cords 34, 42 to the first and second ends 38, 46 of the cleaning body 22. In some embodiments, the stitching 70 is sewn through the terminal ends of the first and second pull-cords 34, 42 to form the end loops 60. As shown in FIG. 2, in embodiments where the locking mechanism 50 are end loops 60, additional stitching 70 may be used to loop over the terminal ends of the first and second pull-cords 34, 42 to form the end loops 60. One or more pieces of expanded shrink tubing 74 may be positioned around the first and second connecting portions 62, 66 and heated or otherwise shrunk to form a seal over the stitching 70 of each respective connecting portion 62, 66.

The first and second pull-cord 34, 42 are respectively coupled to the first and second ends 38, 46 of the cleaning body 22 with stitching 70 using a thread made of the same type of poly-paraphenylene terephthalamide or aramid fiber material as the pull-cords 34, 42 and tubular sheath 30 described above. The end loops 60 of the pull-cords 34, 42 may also be formed by sewing the pull-cords 34, 42 onto themselves by using a poly-paraphenylene terephthalamide thread or stitching 70.

In some embodiments, the first and second pull-cords 34, 42 are each the same length. In other embodiments, the first and second pull-cords 34, 42 are different lengths. In yet other embodiments, a weight can be added to the terminal end of one or both of the pull-cords 34, 42 to assist the user in threading the cleaning and blocking device 10 down the bore 14 of the barrel 78.

The diameter of the foam core 26 can be matched with the diameter of the tubular sheath 30 with the two diameters matching or matching within a range of about 50%. For example, if the foam core 26 has a diameter of ½", the tubular sheath 30 can also have a diameter of ½". The cleaning body 22 is the resultant structure once the foam core 26 is coupled or positioned in the tubular sheath 30. A larger or smaller tubular sheath 30 can be matched with the foam core 26 but the cleaning ability of the device will vary.

The size or diameter of the foam core 26 relative to the caliber of the firearm 18 is empirically determined. In some embodiments, the cleaning and blocking device 10 has 1 to 3 pounds of pull force per inch of length of the cleaning body 22. Cleaning and blocking devices 10 exhibiting this attribute have desired cleaning versus human effort characteristics. A higher pull force will clean better/faster but the human effort becomes less attractive. Additionally, the appropriate size of the tubular sheath 30 relative to the thickness of the foam core 26 is determined empirically. Appropriate sizing can be optimized by checking cleaning performance (using various cleaning solvents) and ease of manufacturing.

In some embodiments, when determining the length of the foam core 26 for pistols, a 6" cleaning body 22, 12" first pull-cord 34, and 9" second pull-cord 42 were selected. These parameters were optimized for the 3 major pistols in the market: a 1911 (Springfield, Remington, Colt, and many others with a 5 inch barrel, Glock 17 (4.5" barrel), and Sig Sauer P226 (4.6 inch barrel). For these barrels, the cleaning body 22 slightly extends beyond the length of the barrel 78.

In other embodiments, when determining the length of the foam core 26 for rifles, an 18" cleaning body 22, 30" first pull-cord 34, and 24" second pull-cord 42 were selected. These parameters were optimized for 18" barrels, though a longer cleaning body 22 can be easily accommodated because of the longer pull-cords.

In still other embodiments, when determining the length of the foam core 26 for shotguns, a 12" cleaning body 22, 48" first pull-cord 34, and 36" second pull-cord 42 were selected. These parameters were optimized for 24" barrels 78, though a longer cleaning body 22 can be easily accommodated because of the longer pull-cords. The shorter cleaning body 22 is acceptable as the vast majority of shotguns don't have rifling in their barrels.

A natural or non-colored poly-paraphenylene terephthalamide is typically used. Common firearm barrel cleaner solvents will leach or dissolve common dyes used for coloring aramid fibers. As bore crud commonly cleaned from firearm barrels is dark grey to black in color, this shows up clearly on the natural pale yellow color of poly-paraphenylene terephthalamide. This helps in determining when a firearm barrel is clean.

When braided tubular poly-paraphenylene terephthalamide is used for the tubular sheath 30, the material will expand/contract to match the bore diameter of the firearm barrel being cleaned. The braided tubular poly-paraphenylene terephthalamide will expand/contract approximately +/−20% in diameter. To clean firearm barrels ranging in size from .17 HMR (Hornady Magnum Round) through 12 gauge shotgun, ¼", ⅜", ½", ⅝", ¾", and 1.0" diameter, the braided poly-paraphenylene terephthalamide can be used. The exact weight or size of the cleaning body 22 used is dependent upon firearm caliber and manufacturing issues of loading the foam core 26 into the tubular sheath 30. In some embodiments, the custom braided tubular poly-paraphenylene terephthalamide diameters can be specified to clean large caliber weapons ranging from 20 mm canons to 16" battleship deck guns, and beyond.

Figure 3:
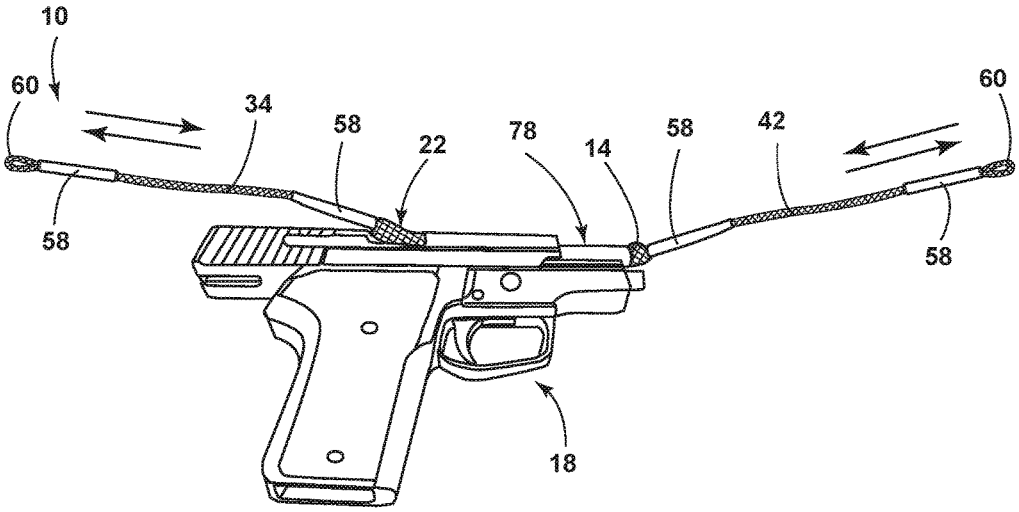
FIG. 3 is a perspective view of a firearm and the cleaning and blocking device positioned in the firearm according to one aspect of the present disclosure.

Referring now to FIG. 3, the cleaning and blocking device 10 is shown positioned in the bore 14 of a barrel 78 of the firearm 18. The cleaning body 22, once positioned in the bore 14, can be pulled back and forth at least once through the bore 14 to scrub and clean unwanted residues from surfaces of the bore 14 to clean the firearm 18.

The cleaning and blocking device 10 should be pulled back and forth through the bore 14 of the barrel 78 at least once with the pull-cords. In some examples, the gun barrel cleaning and blocking device should be pulled back and forth at least 1 to 5 times, at least 2 to 4 times, or about 3 times to efficiently clean the bore of the barrel.

In some embodiments, before inserting the cleaning and blocking device 10 into the bore 14 of the barrel 78, a cleaning solvent or solution should be applied to the cleaning body 22 of the cleaning and blocking device 10. The cleaning solvent or solution can comprise acetone, methyl ethyl ketone (MEK), detergents, petroleum distillates, lubricants, a special anti-friction agent, corrosion inhibitors, or a combination thereof. The design of the cleaning and blocking device 10 makes it easy to dip one end of the cleaning body 22 into a cleaning solvent or solution and begin working it through the bore 14 of the barrel 78.

In some embodiments, the cleaning solution used with the cleaning and blocking device 10 is comprised of acetone, methyl ethyl ketone (MEK), plus detergents, lubricants, and a special anti-friction agent which also acts a corrosion inhibitor. Additional common cleaners that have been successfully used are petroleum distillates (Hopper 9) and mineral oil-based cleaners (QCG).

Figure 4:
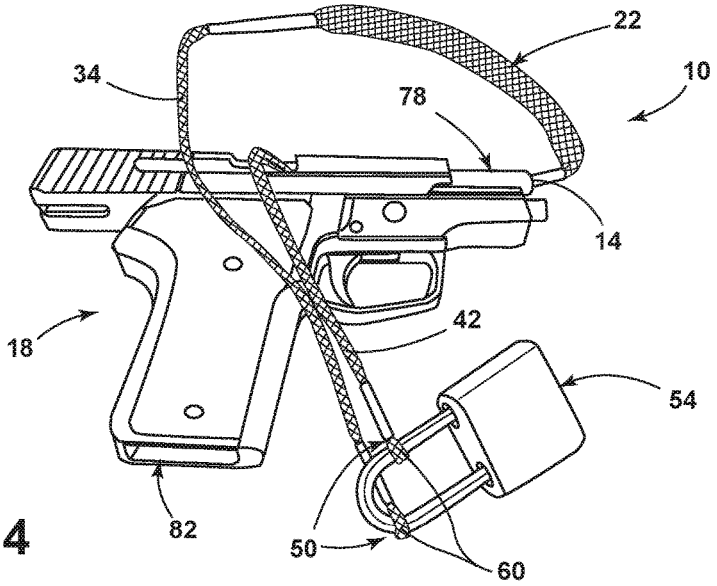
FIG. 4 is a perspective view of a locked cleaning and blocking device securing a firearm through the barrel according to one aspect of the present disclosure.

Referring now to FIG. 4, the cleaning and blocking device 10 is shown positioned in the bore 14 of the firearm 18 with the locking mechanism 50 initiated by placing the lock 54 through the end loops 60 of the first and second pull-cords 34, 42. A user of the firearm 18 will be unable to load a round into the barrel 78 of the firearm 18 as long as the cleaning and blocking device 10 is positioned in the bore 14.

Figure 5:
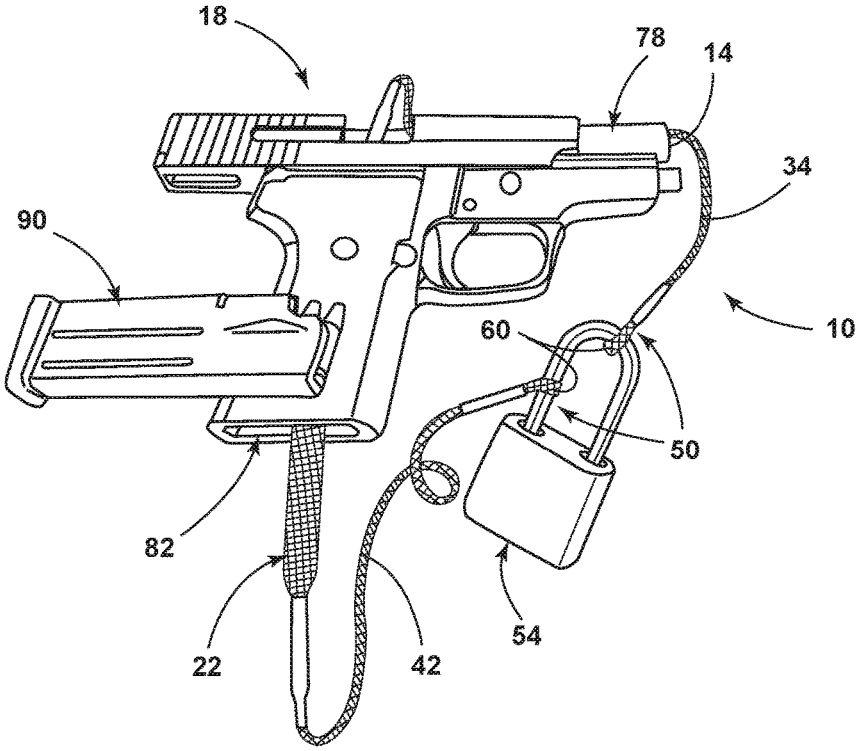
FIG. 5 is a perspective view of a locked cleaning and blocking device securing a firearm through the barrel and grip frame according to one aspect of the present disclosure.

Referring now to FIG. 5, the cleaning and blocking device 10 is shown positioned through the bore 14 of the barrel 78 of the firearm 18, and in addition, is positioned through a grip frame 82 of the firearm 18. With the cleaning and blocking device positioned in both the grip frame 82 and the bore 14, a user will be unable to load a magazine 90 or chamber a round into the barrel 78. The locking mechanism 50 shown uses end loops 60 coupled to the first and second pull-cords 34, 42 that can be coupled with the lock 54.

Figure 6:
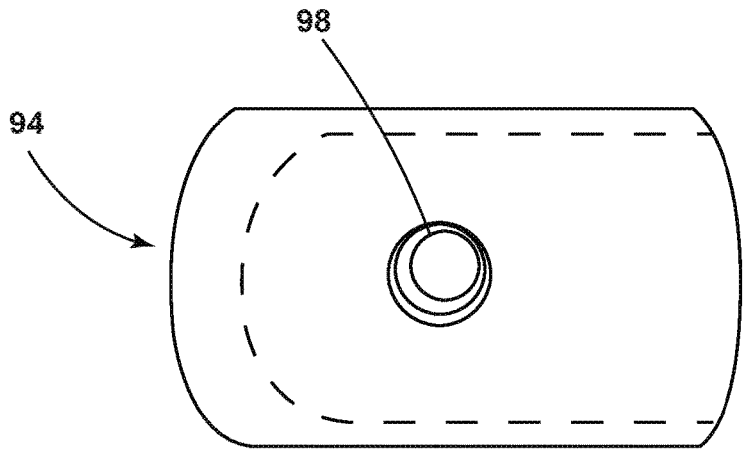
FIG. 6 is a side view of a locking cap according to one aspect of the present disclosure.

Referring now to FIG. 6, a locking cap 94 is shown having one or more cap holes 98. The locking cap 94 may be molded, cast, machined, or constructed from metal, plastic, or other rigid material to form a hollow cylinder having one open end of the cylinder and one or more holes in which to run the shackle 86 of the lock 54 through. In some embodiments, the locking cap 94 is a single piece of metal, plastic, or other rigid material having two cap holes 98 positioned directly across from each other on the cylinder. In other embodiments, the locking cap 94 can have any geometric shape that is elongated so the stiffened end members 120 of the first and second pull-cords 34, 42 can be looped through to lock, for example, a cross-sectional area of a square, rectangle, pentagon, hexagon on an outer and/or inner edge of the locking cap 94. In other embodiments, the locking cap 94 may be formed or constructed using two or more pieces, for example, a top member 102, a bottom member 106, and an inner member 110 (shown in FIG. 7). At least one end of the locking cap 94 remains open so the stiffened ends 120 of the cleaning and blocking device 10 can be inserted and looped through to place the shackle 86 through to lock (shown in FIG. 9).

Figure 7:
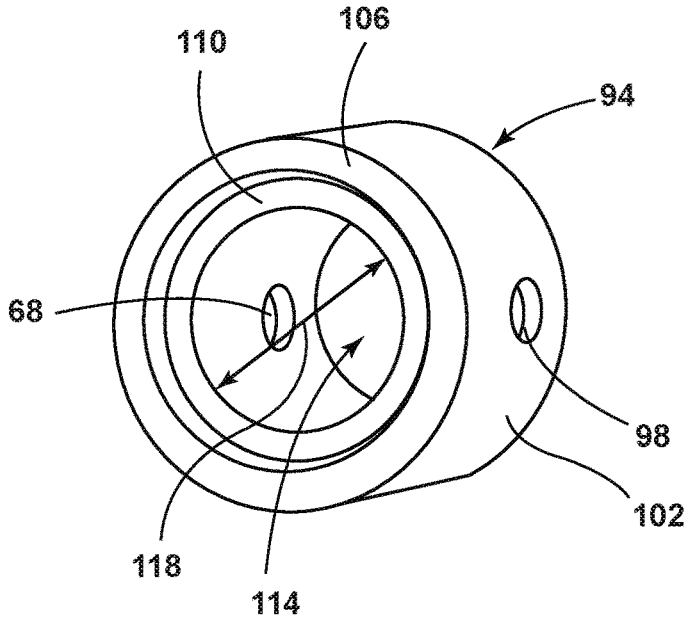
FIG. 7 is a bottom view of the locking cap according to one aspect of the present disclosure.

Referring now to FIG. 7, a bottom view of the locking cap 94 is shown having a cap diameter 118 defined by the cap opening 114. In some embodiments, the inner member 110 is coupled to the top and bottom members 102, 106 but in some embodiments the locking cap may be constructed or molded as a single piece. The locking cap 94 may be constructed from a thermoset or thermoplastic polymer or from other polymer or metal composites. In some embodiments, the locking cap 94 is molded as a single piece from polyvinylchloride. In other embodiments, the locking cap 94 is constructed from the top, bottom, and inner members 102, 106, 110 that may be cast or injection molded from a polymeric material. In embodiments using the locking cap 94 as the locking mechanism 50, the cap diameter 118 should be designed to be shorter than the length of the stiffened end members 120.

Figure 8:
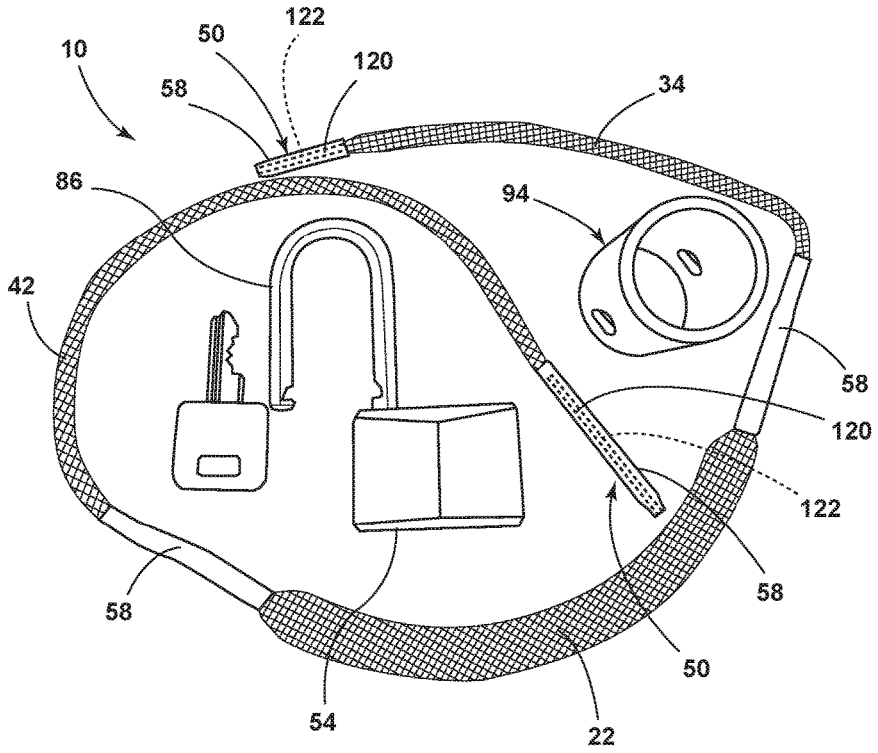
FIG. 8 is a perspective view of a cleaning and blocking device and bottom view of the locking cap according to one aspect of the present disclosure.

Referring now to FIG. 8, in some embodiments, the locking mechanism 50 is formed by positioning a metal rod 122 in the terminal ends of the first and second pull-cords 34, 42 and then kept in place with an adhesive and/or shrink tube cover 58. In some embodiments, the metal rod 122 has one or more ribs or a surface texture to help prevent the metal rod 122 from slipping along the fabric of the first and second pull-cords 34, 42. The stiffened end members 120 of the cleaning and blocking device 10 make up the locking mechanism 50 which is coupled to the first and second pull-cords 34, 42 where the pull-cords 34, 42 are connected to the cleaning body 22. In some embodiments, the metal rods 122 are positioned in the terminal ends of the first and second pull-cords 34, 42 using an adhesive and the terminal ends are dipped in or are contacted with an epoxy or other resin material that can be cured to provide a resin cover providing a more robust and/or chemically stable environment for the covered stiffened end members 120. With regards to the respective lengths of the stiffened end members 120, in some embodiments the stiffened end members 120 are each the same length and in other embodiments the stiffened end members 120 have different lengths.

Figure 9:
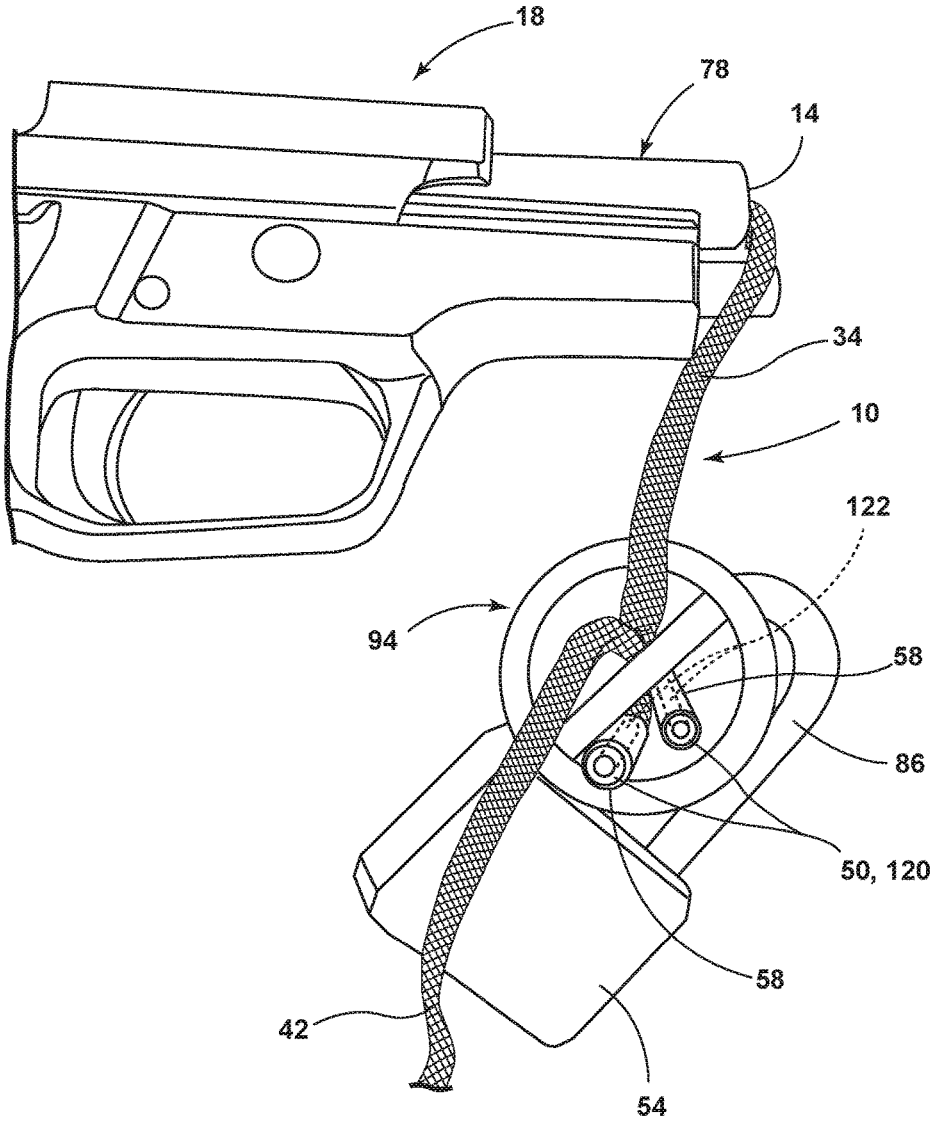
FIG. 9 is a partially schematic perspective view of a locked cleaning and blocking device securing a firearm using the locking cap according to one aspect of the present disclosure.

Referring now to FIG. 9, the locking mechanism 50 is a pair of stiffened end members 120 that utilize the metal rods 122 positioned in the terminal ends of the first and second pull-cords 34, 42 that are then placed in the locking cap 94 so that the stiffened end members 120 are positioned on one side of the shackle 86 while the first and second pull-cords 34, 42 loop around on the other side of the shackle 86 of the lock 54. The cleaning and blocking device 10 is positioned so that the cleaning body 22 and the coupled first and second pull-cords 34, 42 are positioned in the bore 14 of the barrel 78 and may additionally be placed in the grip frame 82 (shown in FIG. 4).

Figure 10:
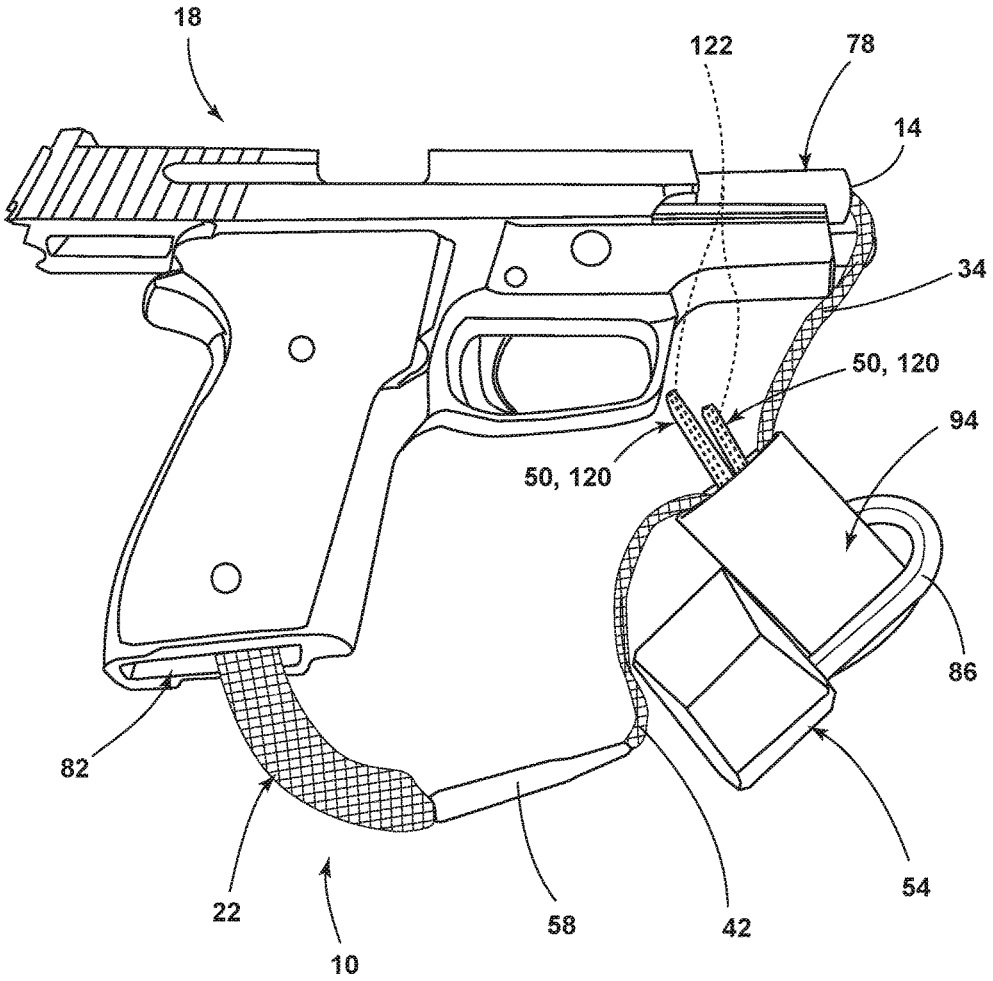
FIG. 10 is a perspective view of a locked cleaning and blocking device securing a firearm using the locking cap according to one aspect of the present disclosure.

Referring now to FIG. 10, the cleaning and blocking device 10 is positioned in the bore 14 of the barrel 78 and the grip frame 82 where the locking mechanism 50 is the stiffened end members 120 having the metal rods 122 positioned in the terminal ends of the first and second pull-cords 34, 42.

Figure 11A:
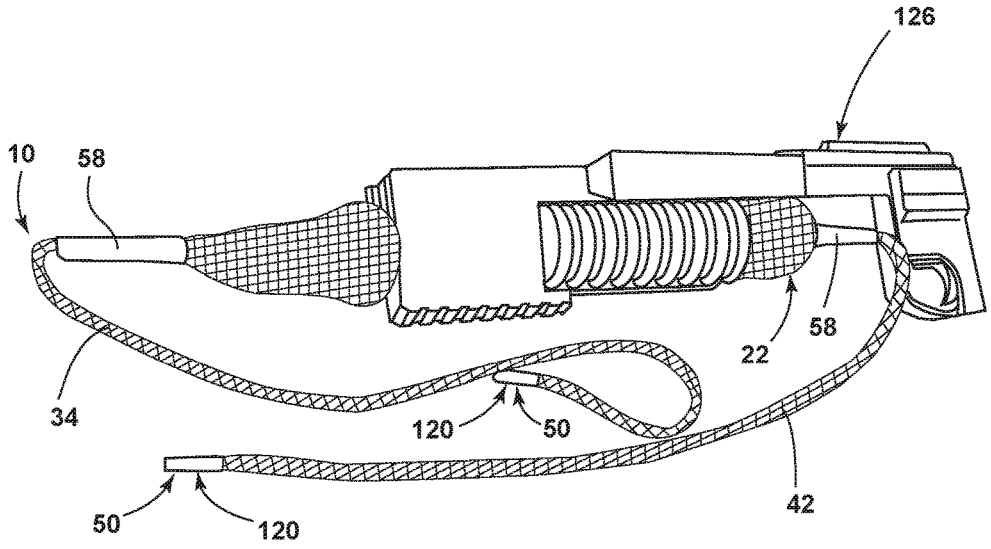
FIG. 11A is a perspective view of a cleaning and blocking device securing a grenade launcher through the barrel according to one aspect of the present disclosure.
Figure 11B:
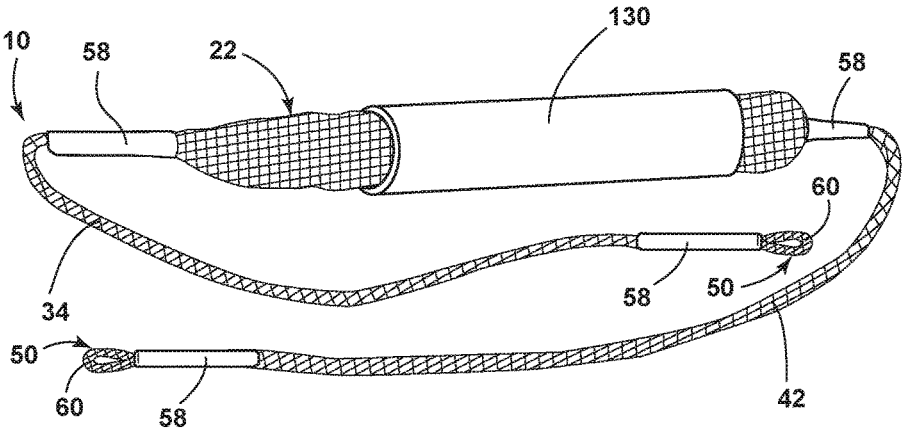
FIG. 11B is a perspective view of a cleaning and blocking device securing a tube having two open ends according to one aspect of the present disclosure.
Figure 12:
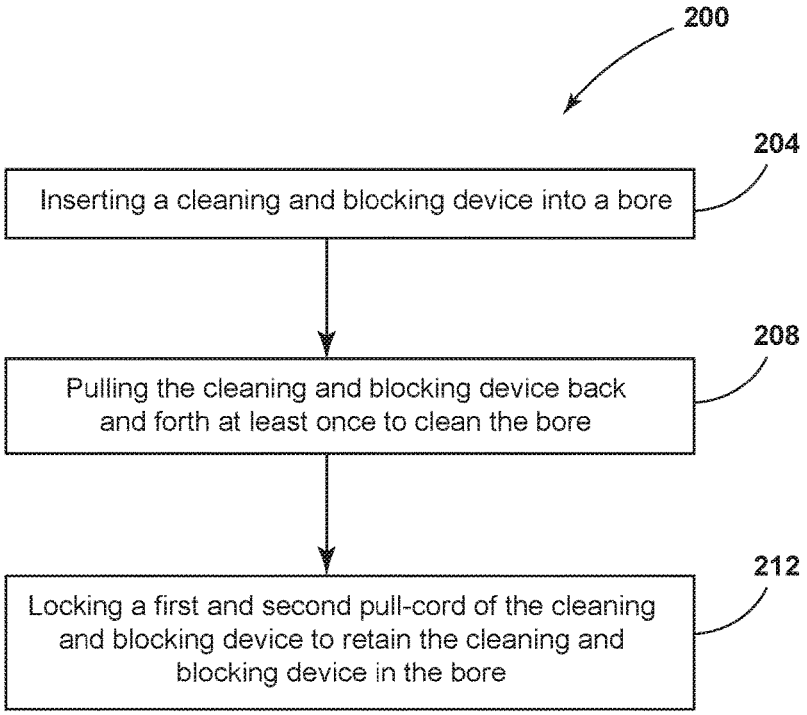
FIG. 12 is a flow diagram of a method for cleaning and blocking a tube having at least two openings.

Referring now to FIGS. 11A-11B, the cleaning and blocking device 10 is shown positioned in a grenade launcher 126 and a tube 130 having at least two openings or open ends. The cleaning and blocking device 10 shown in both embodiments contains the cleaning body 22 coupled to the first and second pull-cords 34, 42 with the stiffened end members 120 (FIG. 11A) and the end loops 60 (FIG. 11B) used as the respective locking mechanism 50. In some embodiments, the cleaning and blocking device 10 can scrub and clean the inside diameter of pipes or any cylindrical object which may have foreign contaminants coupled or loosely bound to its interior surface.

Referring now to FIGS. 1-12, a method 200 for cleaning and blocking the bore 14 of the firearm 18 or the tube 130 having at least two open ends is shown. The method 200 includes inserting the cleaning and blocking device into the bore 14 (step 204) and then pulling the cleaning and blocking device 10 back and forth at least once to clean the bore 14 (step 208). Next, the method includes locking the cleaning and blocking device 10 by coupling the locking mechanism 50 of the first and second pull-cords 34, 42 (step 212).

In some embodiments, the cleaning action of the cleaning and blocking device 10 can be performed or achieved by inserting the cleaning and blocking device into the bore 14 or the tube 130 having at least two open ends (step 204). Pulling the cleaning and blocking device 10 back and forth at least once to clean the bore 14 (step 208) provides additional cleaning that may or may not be required based on the cleanliness of the bore 14 or tube 130. In such embodiments, the method includes: inserting the cleaning and blocking device into the tube, the device including the cleaning body 22 having the foam core 26 enclosed in the tubular sheath 30, the first pull-cord 34 coupled to the first end 38 of the cleaning body 22 and the second pull-cord 42 coupled to the second end 46 of the cleaning body 22, and the locking mechanism 50 coupled to the first and second pull-cords 34, 42, and locking the cleaning and blocking device 10 by coupling the locking mechanism 50 of the first and second pull-cord heads 34, 42.

It is understood that the descriptions outlining and teaching a gun bore cleaning and blocking device previously discussed, which can be used in any combination, apply equally well to the second embodiment of the disclosure where applicable, disclosing a method for cleaning and blocking a bore of a gun barrel.

With regard to the length of the pull-cords 34, 42, in some embodiments the first pull-cord 34 is the longer of the pull-cords. In some embodiments, the first and second pull-cords 34, 42 are sufficiently long so the cleaning body 22 can be pulled back and forth to scrub the bore 14 of the barrel 78. This is back and forth cleaning mechanism is different from brush-based cleaning systems since brush-based cleaning systems are unidirectional, that is they can only go in a single direction per pass. The cleaning and blocking device 10 does not have a brush and can be pulled in either direction, at any time, through the bore 14. This cleaning and blocking device 10 facilitates much faster and more thorough cleaning than traditional and currently available cleaning devices.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for cleaning and blocking a bore of a firearm, the method comprising:

providing a cleaning and blocking device, the device comprising of a cleaning body having a foam core enclosed in a tubular sheath, a first pull-cord coupled to a first end of the cleaning body and a second pull-cord coupled to a second end of the cleaning body, wherein the cleaning and blocking device is a single woven and/or sewn device;

inserting the first or the second pull-cord into the bore of the firearm;

optionally pulling the cleaning body back and forth at least once through the bore with at least one of the pull-cords;

inserting both a first stiffened end of the first pull-cord and a second stiffened end of the second pull-cord into a locking cap;

looping the first and second stiffened ends around a lock shackle positioned through the locking cap; and locking the cleaning and blocking device into the bore of the firearm by fastening the lock shackle of a lock.

2. The method for cleaning and blocking a bore of a firearm of claim 1, wherein the tubular sheath is made from a braided poly-paraphenylene terephthalamide or a braided poly aramid material.

3. The method for cleaning and blocking a bore of a firearm of claim 1, wherein the foam core is made from a closed-cell non-absorbent polymer.

4. The method for cleaning and blocking a bore of a firearm of claim 1, wherein the first and second pull-cords are made from a woven poly-paraphenylene terephthalamide or a poly aramid material.

5. The method for cleaning and blocking a bore of a firearm of claim 1 wherein the cleaning body further comprises one or more shrink tube covers enclosing the first and second ends of the cleaning body coupled to the first and second pull-cords.

6. The method for cleaning and blocking a bore of a firearm of claim 1, wherein the first and second stiffened ends each comprise a metal rod positioned in each terminal end of the first and second pull-cords.

* * * * *